US009555658B2

(12) United States Patent
Busam

(10) Patent No.: US 9,555,658 B2
(45) Date of Patent: Jan. 31, 2017

(54) EXPANDABLE CAPACITY POCKET DIVIDER

(71) Applicant: ACCO Brands Corporation, Lake Zurich, IL (US)

(72) Inventor: Edward P. Busam, Mason, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 80 days.

(21) Appl. No.: 14/150,932

(22) Filed: Jan. 9, 2014

(65) Prior Publication Data

US 2014/0191020 A1 Jul. 10, 2014

Related U.S. Application Data

(60) Provisional application No. 61/750,560, filed on Jan. 9, 2013.

(51) Int. Cl.
*B42D 1/00* (2006.01)
*B42D 1/06* (2006.01)
*B42F 7/02* (2006.01)

(52) U.S. Cl.
CPC ..... *B42D 1/007* (2013.01); *B42D 1/06* (2013.01); *B42F 7/02* (2013.01)

(58) Field of Classification Search
CPC ..... B42F 19/00; B42F 21/08; B42F 21/00; B42F 21/06; Y10S 402/50
USPC ..... 229/67.1–67.4; 281/31, 38; 402/79
See application file for complete search history.

(56) References Cited

U.S. PATENT DOCUMENTS

| | | | | |
|---|---|---|---|---|
| 5,125,561 | A * | 6/1992 | Idstein | 229/400 |
| 5,417,509 | A * | 5/1995 | Schwartz | 402/79 |
| 5,836,507 | A * | 11/1998 | Mueller et al. | 229/67.1 |
| D432,166 | S * | 10/2000 | Matheson | D19/33 |
| 6,168,340 | B1 * | 1/2001 | Lehmann et al. | 402/79 |
| 6,382,864 | B1 * | 5/2002 | Moor | 402/79 |
| 6,666,610 | B1 | 12/2003 | Moor et al. | |
| 6,739,785 | B2 * | 5/2004 | Moor | 402/79 |
| 6,752,428 | B2 * | 6/2004 | Sapienza et al. | 283/36 |
| 8,162,204 | B2 | 4/2012 | Makofsky | |
| 2002/0102125 | A1 * | 8/2002 | Sapienza et al. | 402/79 |
| 2007/0086847 | A1 * | 4/2007 | Russo | 402/79 |
| 2009/0079180 | A1 * | 3/2009 | Zuniga | 281/21.1 |
| 2012/0175407 | A1 * | 7/2012 | Busam et al. | 229/67.1 |
| 2012/0201594 | A1 * | 8/2012 | Busam et al. | 402/4 |
| 2014/0191021 | A1 * | 7/2014 | Busam | 229/67.3 |

* cited by examiner

*Primary Examiner* — Peter Helvey
(74) *Attorney, Agent, or Firm* — Thompson Hine LLP

(57) ABSTRACT

A pocket divider including a major panel including a plurality of binding holes formed therein and a pocket panel coupled to the major panel and defining a pocket therewith. The pocket panel includes at least one binding hole formed therein. The pocket divider further includes a binding mechanism extending through the binding holes of the major panel and the at least one binding hole of the pocket panel. The at least one binding hole of the pocket panel is elongated to provide expansion capacity to the pocket.

43 Claims, 11 Drawing Sheets

FIG. 7A
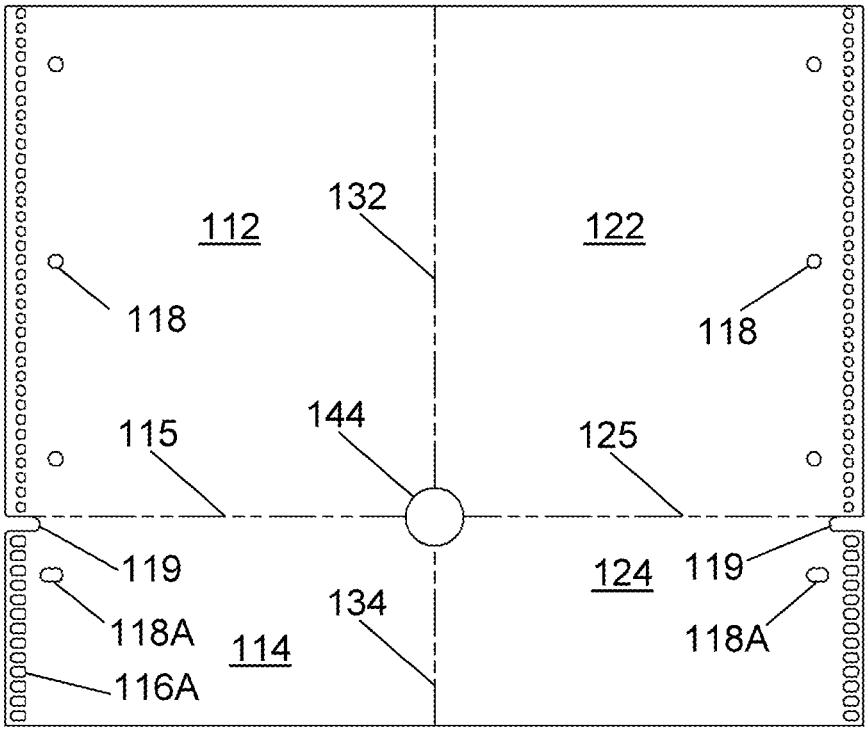
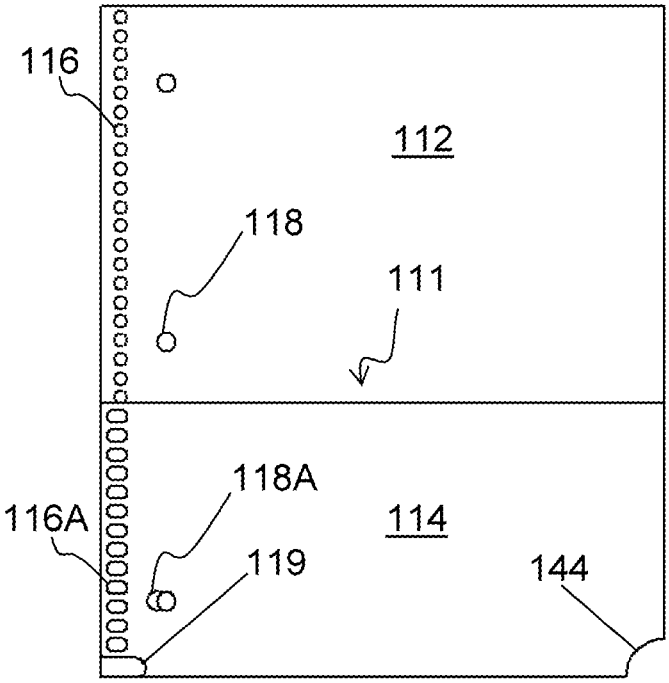
FIG. 7B

FIG. 8A
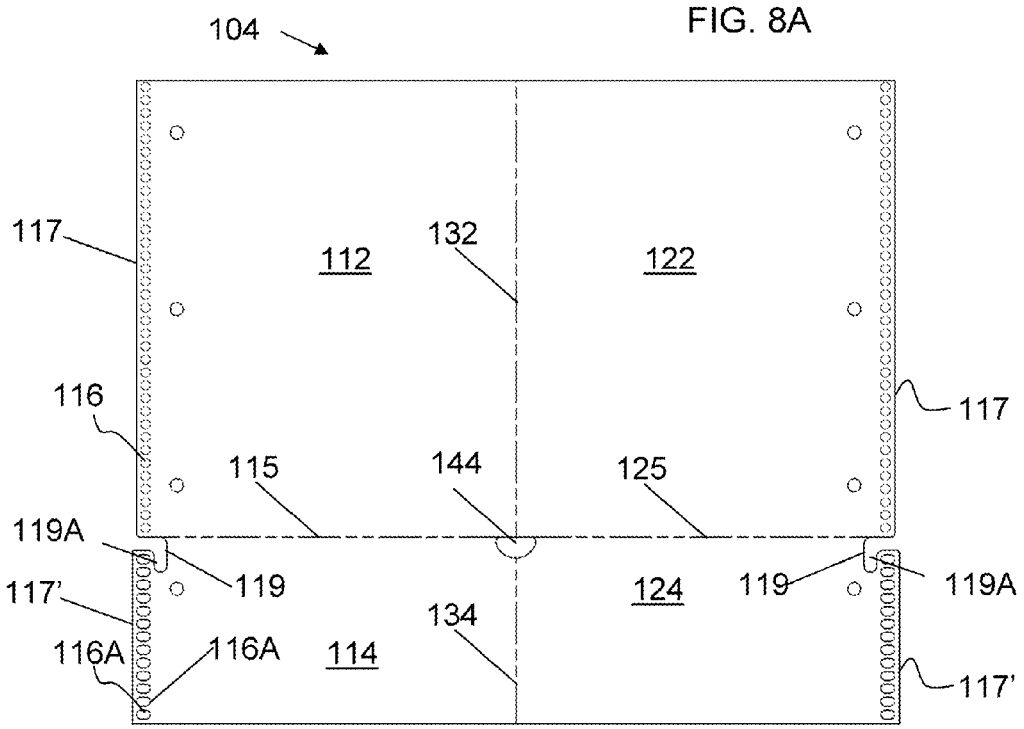
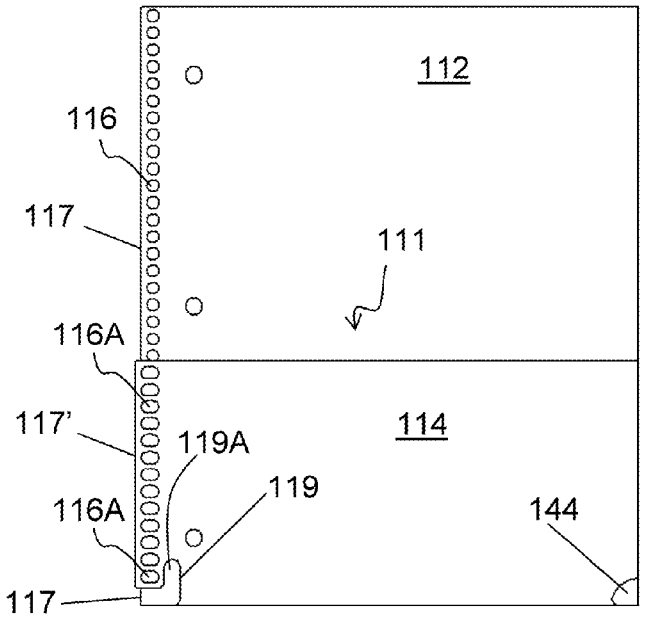
FIG. 8B

FIG. 9A
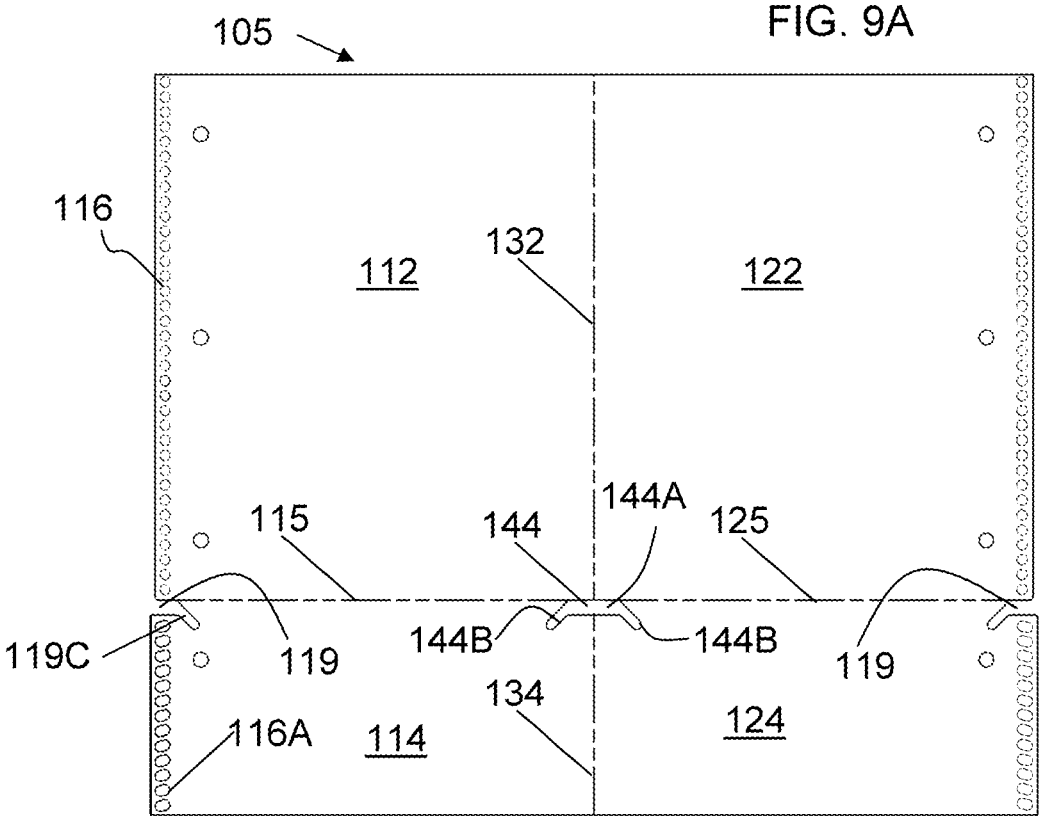
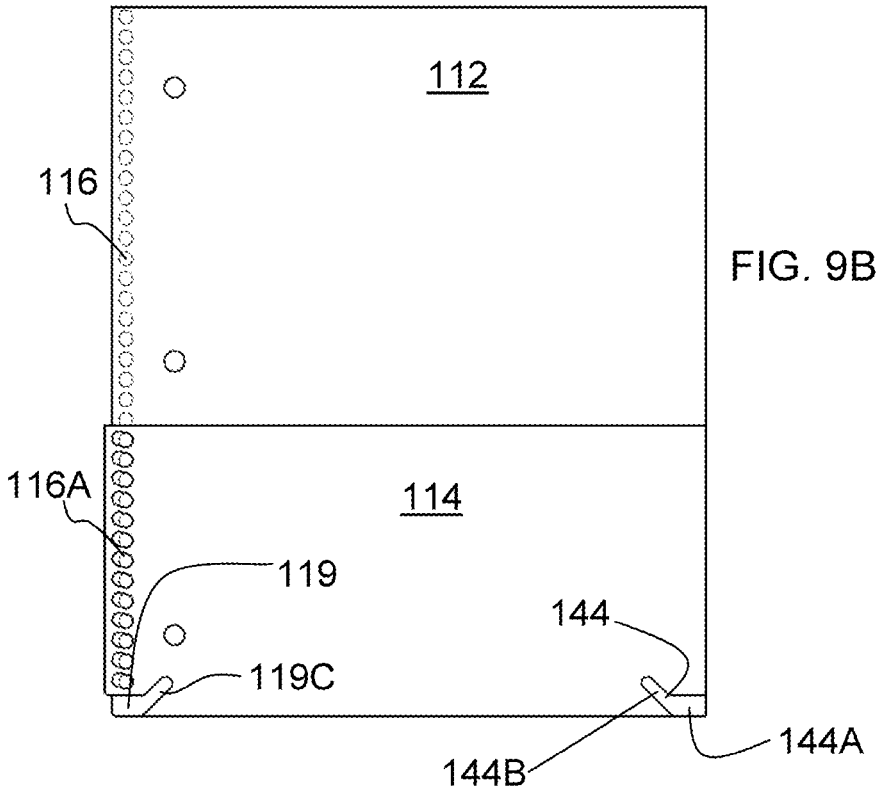
FIG. 9B

EXPANDABLE CAPACITY POCKET DIVIDER

This application claims priority to U.S. Provisional Application Ser. No. 61/750,560 entitled EXPANDABLE CAPACITY POCKET DIVIDER filed on Jan. 9, 2013, the entire contents of which are hereby incorporated by reference.

The present invention is directed to a pocket divider, and more particularly, to a pocket divider having an expandable capacity.

BACKGROUND

Pocket dividers or folders may be used to store various items such as loose papers, writing utensils, or the like. In some cases, the shape and configuration of the pocket divider may limit its storage capacity. The storage capacity can be particularly limited when the pocket of the pocket divider is bound on one or more sides, or is bound into a component such as a notebook.

SUMMARY

In one embodiment, the invention is a pocket divider including a major panel including a plurality of binding holes formed therein and a pocket panel coupled to the major panel and defining a pocket therewith. The pocket panel includes at least one binding hole formed therein. The pocket divider further includes a binding mechanism extending through the binding holes of the major panel and the at least one binding hole of the pocket panel. The at least one binding hole of the pocket panel is elongated to provide expansion capacity to the pocket.

BRIEF DESCRIPTION OF THE DRAWINGS

FIG. 7A is a top view of another alternate blank that can be used to form a pocket divider;

FIG. 7B is a top view of the blank of FIG. 7A formed into a pocket divider;

FIG. 8A is a top view of another alternate blank that can be used to form a pocket divider;

FIG. 8B is a top view of the blank of FIG. 8A formed into a pocket divider;

FIG. 9A is a top view of another alternate blank that can be used to form a pocket divider;

FIG. 9B is a top view of the blank of FIG. 9A formed into a pocket divider;

DETAILED DESCRIPTION

Figure 3:
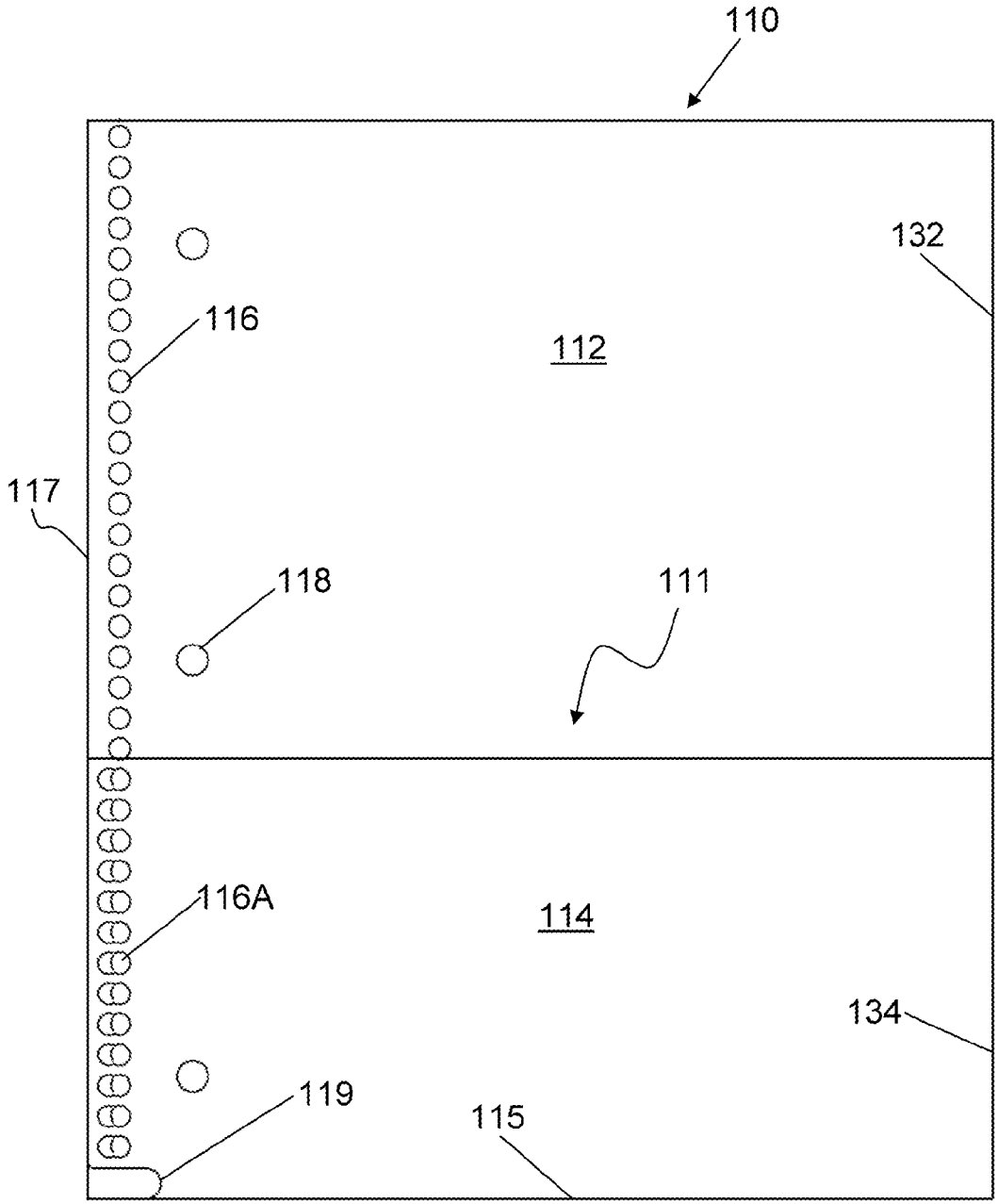
FIG. 3 is a top view of the blank of FIG. 2, folded about its centerline.
Figure 3A:
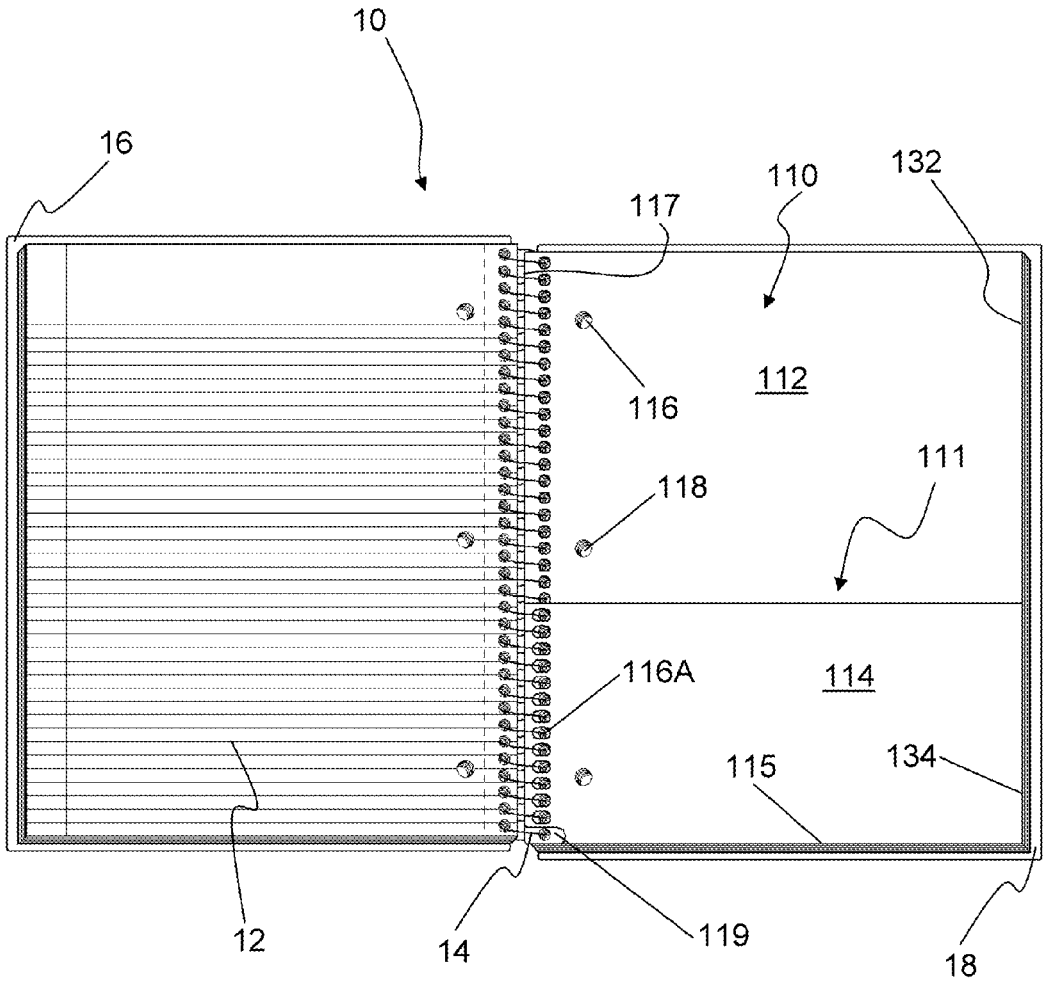
FIG. 3A is a top view of a notebook with the pocket divider of FIG. 3 bound thereto.

As shown in FIG. 3A, a pocket/pocket divider 110 can be part of, or used in conjunction with, a notebook, generally designated 10. In one embodiment the notebook 10 includes a set of papers 12 bound together by a binding mechanism 14, such as a coil binding mechanism, a spiral binding mechanism, twin-wire binding mechanism, adhesive bindings, sewn or stapled binding mechanism and the like. The papers 12 may be made of cellulose based or pulp based paper or the like that can easily be written upon by a variety of marking instruments, such as pens, pencils, markers, etc. The notebook 10 can include a front cover 16 and a back cover 18 that are bound to the papers 12 by the binding mechanism 14. The notebook 10 can further include one or more pocket dividers 110 spaced throughout the thickness of the notebook 10/papers 12.

Each pocket divider 110 can operate as a divider to segregate various portions of the papers 12 for ease of access and use. Each pocket divider 110 may have the same or generally the same footprint/outer dimensions as the papers 12/covers 16, 18 or other contents in the stack. Alternatively, the pocket divider 110 may protrude outwardly in any direction in the plane of the pocket divider 110, and/or be recessed inwardly in any direction in the plane, to provide a tactile separator function. Each pocket divider 110 can include one or more pockets 111 to store loose items therein.

Figure 1:
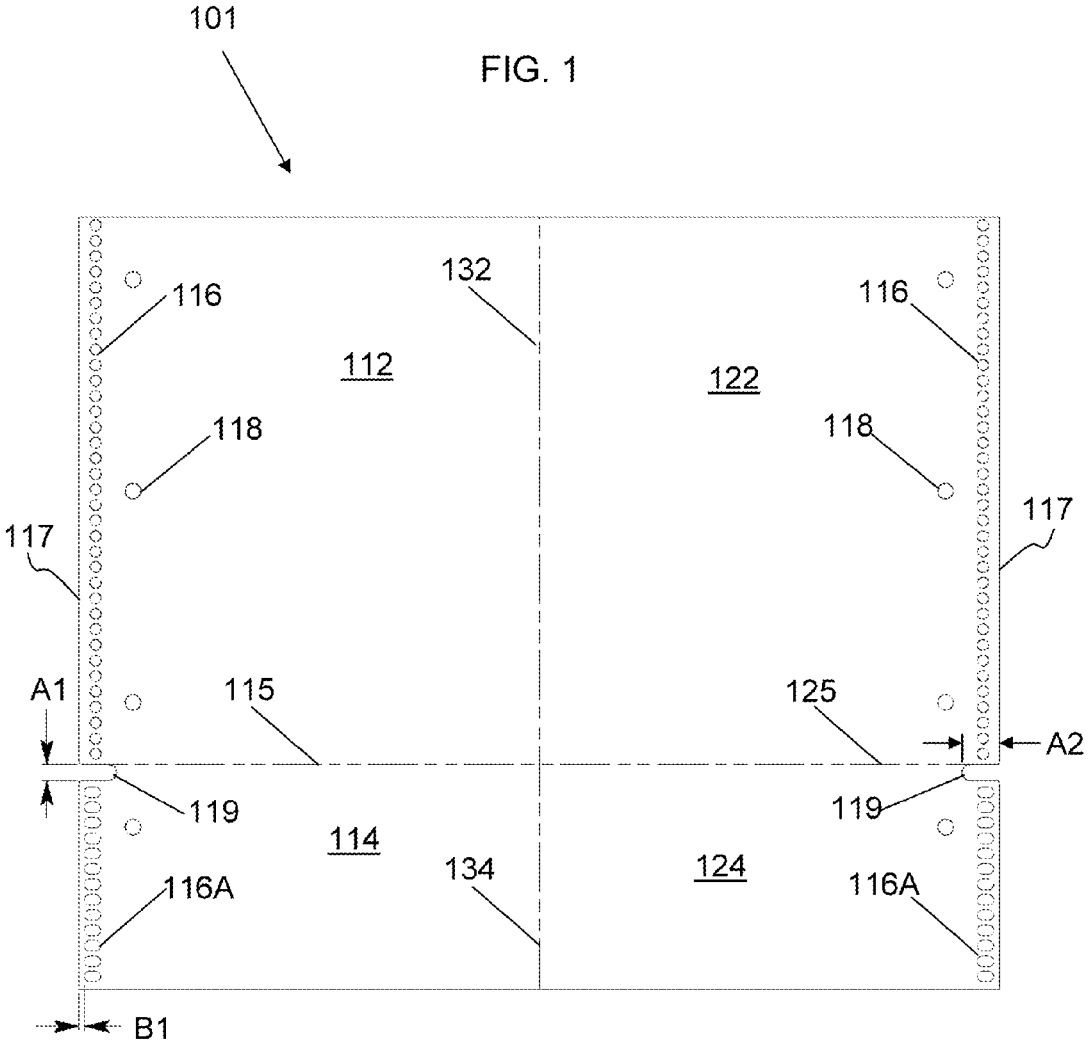
FIG. 1 is a top view of a blank that can be used to form a pocket divider.

Each pocket divider 110 can be made from a blank such as the blank 101 shown in FIG. 1. The blank 101 may be made of a relatively thin sheet material that is generally rectangular in shape, and includes a first or front major panel 112, a first or front pocket panel 114, a second or back major panel 122, and a second or back pocket panel 124. The blank 101 includes a horizontally extending front pocket fold line 115 that separates the front major panel 112 from the front pocket panel 114. Blank 101 also includes a horizontally extending back pocket fold line 125 that separates the back major panel 122 from the back pocket panel 124.

The blank 101 further includes a first or major vertical fold line 132 extending between and separating the front major panel 112 and back major panel 122. Finally, blank 101 includes a second or minor or pocket vertical fold line 134 extending between and separating the front pocket panel 114 and back pocket panel 124.

In the blank 101 the horizontal fold lines 115, 125 are collinear and may be considered a single fold line; however once the pocket divider 110 is formed the fold lines 115, 125 may appear more distinct. Similarly the vertical fold lines 132, 134 in blank 101 are collinear and may be considered a single fold line but may become more distinct when the pocket divider 110 is formed.

The blank 101/pocket divider 110 (i.e. including major panels 112, 122 and pocket panels 114, 124) can be made of any of a wide variety of materials, including but not limited to plastic or polymers (such as polypropylene or vinyl), cardboard, paperboard, plastic encased cardboard, etc. It should be noted that the fold lines 115, 125, 132, 134 can be formed as creases or areas of weakness in the blank 101. However, the fold lines 115, 125, 132, 134 need not necessarily be physically present in the blank 101, and can merely be imaginary lines about which the blank 101 is later folded.

The blank 101 may have a plurality of coil binding holes 116, 116A and/or ring binding holes 118 positioned adjacent to the outer edges 117 of the blank 101. The coil binding holes 116, 116A can be spaced and configured to receive turns of the binding mechanism 14 therethrough, and the ring binding holes 118 can be spaced and configured to receive the rings of a ring binder (such as a 3-ring binder with standard ring spacing, not shown) therethrough.

The coil binding holes 116 in the major panels 112, 122 may be generally circular. The coil binding holes 116A formed in the pocket panels 114, 124 may be eccentric, non-circular (including oval, ellipical or the like) and/or elongated such that the holes 116A have a width dimension (i.e. parallel to the pocket fold lines 115, 125, or perpendicular to the longitudinal axis of the binding mechanism 14) that is greater than the height dimension (i.e. parallel to the major 132 and minor 134 fold lines, or parallel to the axis of the binding mechanism 14). As will be described in greater detail below, the shape of the coil binding holes 116A can help to provide an expansion capability. In one case the holes 116A have a width that is at least about 1.2, or at least about 1.5, or at least about 2 times as long as the associated height, to provide sufficient expansion capabilities, but may have a width that is less than about 5 or less than about 2.5 times as long as the height, to avoid unnecessarily weakening the pocket panels 114, 124. The holes 116A in the pocket panels 114, 124 may also have a width dimension that is greater than the width dimension of the holes 116 in the major panels 112, 122. The holes 116 in the major panels 112, 122 can be circular (as shown) or have other shapes, including the shapes described above for the holes 116A.

The outer edge of the holes 116A may be spaced away from the associated, adjacent edge 117 by a distance B1 (FIG. 1). The distance B1 can vary, but in one case is about 0.1 inches, or less than about 0.3 inches, or less than about 1/50 of the lateral dimension of the associated panel 114/124. In one case, the inner edges of the coil binding holes 116A are aligned with the inner edges of the holes 116 on the same side of the blank 101 such that the outer edges of the holes 116A are positioned closer to the associated, adjacent edge 117 than the outer edges of the associated holes 116. However, the holes 116A can be positioned in any of a variety of configurations relative to the holes 116, such that, for example, the inner edges of the holes 116A are positioned inwardly of the inner edges of the holes 116, or both the inner and outer edges of the holes 116A extend beyond those of the holes 116, etc.

As outlined above, the holes 116A can be generally oval, elliptical or the like, but can also have other shapes such as rectangular, etc. Each hole 116A can have a width at least about 5 times greater than a thickness of the turn/wire of the binding mechanism 14 to provide sufficient expansion capacity, as will be described in greater detail below, without unnecessarily weakening the pocket panel 114/124. Each holes 116A can have a width less than about 20 times the thickness of the turn/wire to avoid making the holes 116A so large as to weaken the pocket divider 110. In one embodiment the holes 116A are formed by punching two circular holes (such as holes of the same size and shape of the holes 116) in a partially overlapping manner to form somewhat of a "figure 8" shape. In this case, one of the holes in each "hole pair" 116A can be generally aligned with the holes 116 in the associated major panel 112, 122 such that they can be formed at the same time for manufacturing efficiency.

The blank 101 may include a pair of relief cutouts 119 formed in the in the pocket panels 114, 124. Each relief cutout 119 is positioned adjacent to/intersects an outer edge 117 of the blank 101, and is positioned adjacent to/intersecting an associated pocket fold line 115, 125. Each relief cutout 119 may have a height A1 extending generally parallel to the outer edges 117 that is at least about 0.1 inches in one case, less than about 0.5 inches in one case, or about 0.3 inches in one case. The height A1 may be less than about 1/10 or about 1/20 of the height of the associated pocket panel 114, 124, and may be greater than about 1/40 of the height of the associated pocket panel 114, 124, to provide sufficient expansion capability, as will be described in greater detail below, without removing too much material to weaken the pocket divider 110. Each relief cutout 119 and may extend inwardly, away from the outer edges 117, by a distance A2 such that each relief cutout 119 extends inwardly at least slightly past the line of coil binding holes 116 and/or 116A, to provide sufficient expansion capacity.

Figure 2:
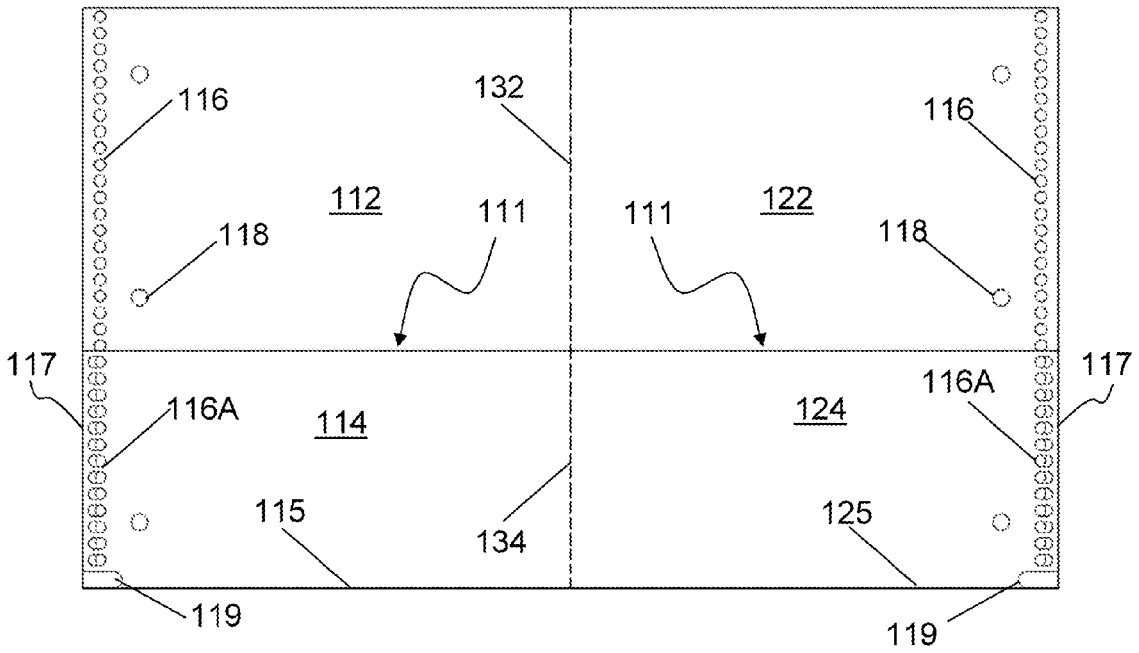
FIG. 2 is a top view of the blank of FIG. 1, with the pocket panels folded up.

As shown in FIG. 2, after the blank 101 of FIG. 1 is provided, the front pocket panel 114 and back pocket panel 124 are folded upwardly about their associated horizontal fold lines 115, 125. After this folding step the front pocket panel 114 overlies, and forms a pocket 111 with, the front major panel 112, and back pocket panel 124 overlies, and forms a pocket 111 with, the back major panel 122. As shown in FIG. 3, the blank 101 of FIG. 2 is then folded outwardly along vertical fold lines 132, 134 causing the front major panels 112, 122 to be aligned and flush against each other. After folding, the edges 117 of the panels 114, 124 may be aligned and coincident (and be configured as inner edges 117 in that configuration), and the coil binding holes 116, 116A of the panels 114, 124 may also be generally aligned.

The coil binding holes 116, 116A and ring binding holes 118 may be made at any stage in the forming/manufacturing process, including in the blank 101 before folding, or after making either of the folds along the fold lines 115/125 or 132/134, or even after assembling the pocket divider 110 into the binding mechanism 14 or other component. When the pocket divider 110 is assembled manually, it may not matter when the holes 116, 118 are formed. In contrast, when the pocket divider 110 is assembled by machine or automatically, it may be advantageous to create holes 116, 116A, 118 after pocket divider 110 has been folded into its position shown in FIG. 3, or after assembling a stack of materials to create a notebook 10 or the like, to ensure the holes 116, 118 are properly aligned.

When the holes 116, 116A are formed after folding the blank 101 about the horizontal fold lines 115, 125 (e.g. in the state shown in FIG. 2), the holes 116A of the pocket panels 114, 124, and the holes 116 of the major panels 112, 122 (or at least those holes 116 underlying the holes 116A) may have the same size and shape. Alternately if it is desired to have binding holes 116A of a different shape from all binding holes 116, the binding holes 116A, 116 may be formed before folding the blank about the horizontal fold lines 115, 125 (e.g. the holes 116A, 116 would be formed when the blank 101 is in the state shown in FIG. 1).

Figure 4:
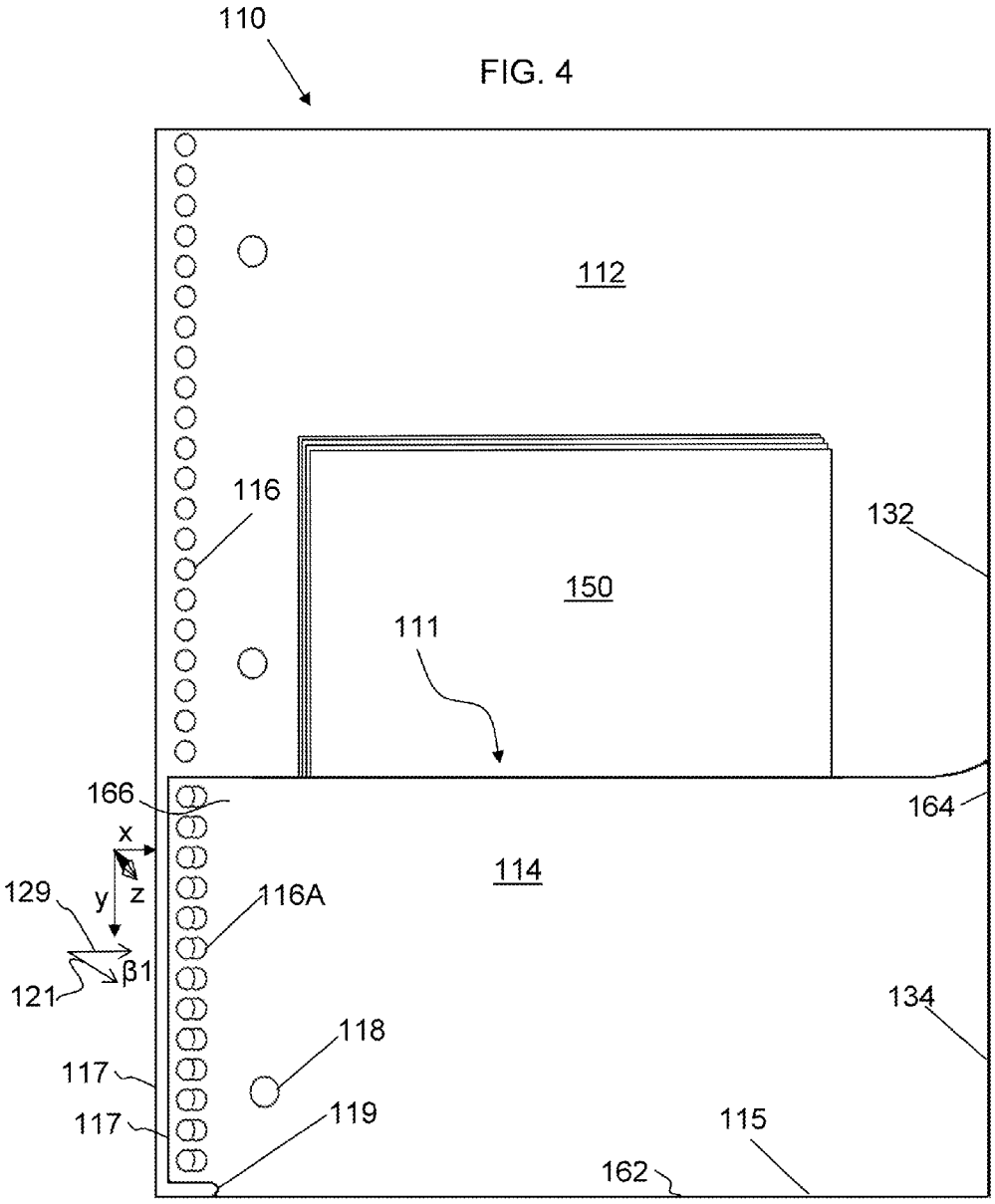
FIG. 4 is a top view of the pocket divider of FIG. 3, with content items stored in the pocket.

When the pocket divider 110 is fully assembled and in the configuration shown in FIGS. 3 and 3A, the presence and positioning of the holes 116A provides expansion capability to the pockets 111. In particular, FIG. 4 illustrates the pocket divider 110 of FIG. 3 with contents, such as a stack of papers 150, positioned in a pocket 111. Since vertical fold line 134 constrains the outer (right) edge of pocket 111, the increased thickness of the contents 150 may pull on the pocket inner/left edge 117. In particular, as can be seen, when the volume of the pocket 111 increases, the inner edge 117 of the pocket panel 114 may be pulled outwardly (to the right in FIG. 4), thereby allowing the pocket 111 to expand. In this manner, lateral movement of the pocket panel 114 enables the perpendicular distance between the pocket panel 114 and associated major panel 112 to increase, thereby increasing the storage capacity of the pocket 111. Once the contents 150 of the pocket 111 are removed, the pocket 111 can return to its flat/low profile shape, as shown in FIGS. 3 and 3A.

If the coil binding holes 116A in pocket panel 114 were to be narrow/circular like the coil binding holes 116 in major panel 112, the interaction of the circular holes 116A and the wire binding 14 could unduly constrain coil binding holes 116A from moving laterally (to the right in FIGS. 3 and 3A) thereby limiting the expansion of the pocket 111. In contrast, the elongated shape of the coil binding holes 116A enables greater lateral movement of the pocket panel 114 such that the capacity of the pocket 111 can be increased and expand to a greater volume.

As pocket 111 expands to accept content items 150, the lower edge of the pocket 111, along fold line 115, will tend to bow forwardly/outwardly to accommodate the content items 150. The forward/outward bowing of the pocket panel 114 will cause the upper edge of the pocket panel 114 to be pulled downward slightly, as illustrated in FIG. 4. The cutout 119 at the lower edge/corner of the pocket 111/pocket panel 114 allows the portions of the panel 114 adjacent to the lower edge 115 to move outwardly/downwardly, and fold somewhat flat in a position generally perpendicular to the major panel 112, providing greater expansion capacity to the pocket 111.

FIG. 4 illustrates some of the movement that may occur as pocket 111 increases in volume/capacity to accommodate content items 150. At position 162, positioned along or adjacent to the lower edge 115 of the pocket divider 110, the panel 114 may move outwardly/forwardly in the z direction during expansion to provide additional capacity. The panel 114 may be made of materials that are generally or relatively inelastic. Thus, in order for the pocket 111 to expand in the z direction, the upper edge of the pocket panel 114 may move downward slightly in the y direction. The cutout 119 enables such downward movement of the pocket panel 114, enabling the lower edge of the pocket panel 114 to flatten out.

At position 164, positioned along or adjacent to the upper outer edge of the pocket 111 adjacent to the vertical fold 134, upon expansion of the pocket divider 110 the panel 114 may move outwardly/forwardly in the z direction to provide increased capacity. Such movement can be seen by the curved upper edge of the pocket panel 114 in FIG. 4 adjacent to position 164.

At position 166, positioned along or adjacent to the edge 117 of the pocket panel 114, during expansion the panel 114 may move outwardly/forwardly in the z direction, downwardly in the y direction, and also laterally/rightward in the x direction. Movement in the x and/or y directions may be limited by engagement of a binding hole 116A with the binding mechanism 14 (such as a wire coil passing through holes 116A). However, the elongated shape of the binding holes 116A, as outlined above, permit greater-than-normal lateral movement of the pocket panel 114 in the x direction, thereby providing greater expansion capabilities.

In the embodiment of FIG. 4, each binding holes 116A is elongated along an axis 129 that extends generally parallel to the fold lines 115 and the top and bottom edges of the pocket divider 110, and generally perpendicular to the binding mechanism 14. When the pocket 110 is expanded, the pocket panel 114, at least at point 166 and at the holes 116A, may move in the plane of the pocket panel 114 (i.e. down and to the right along the x and y axis) along direction 121. As can be seen, direction 121 may form an angle β1 with axis 129 of the binding holes 116A.

Figure 5:
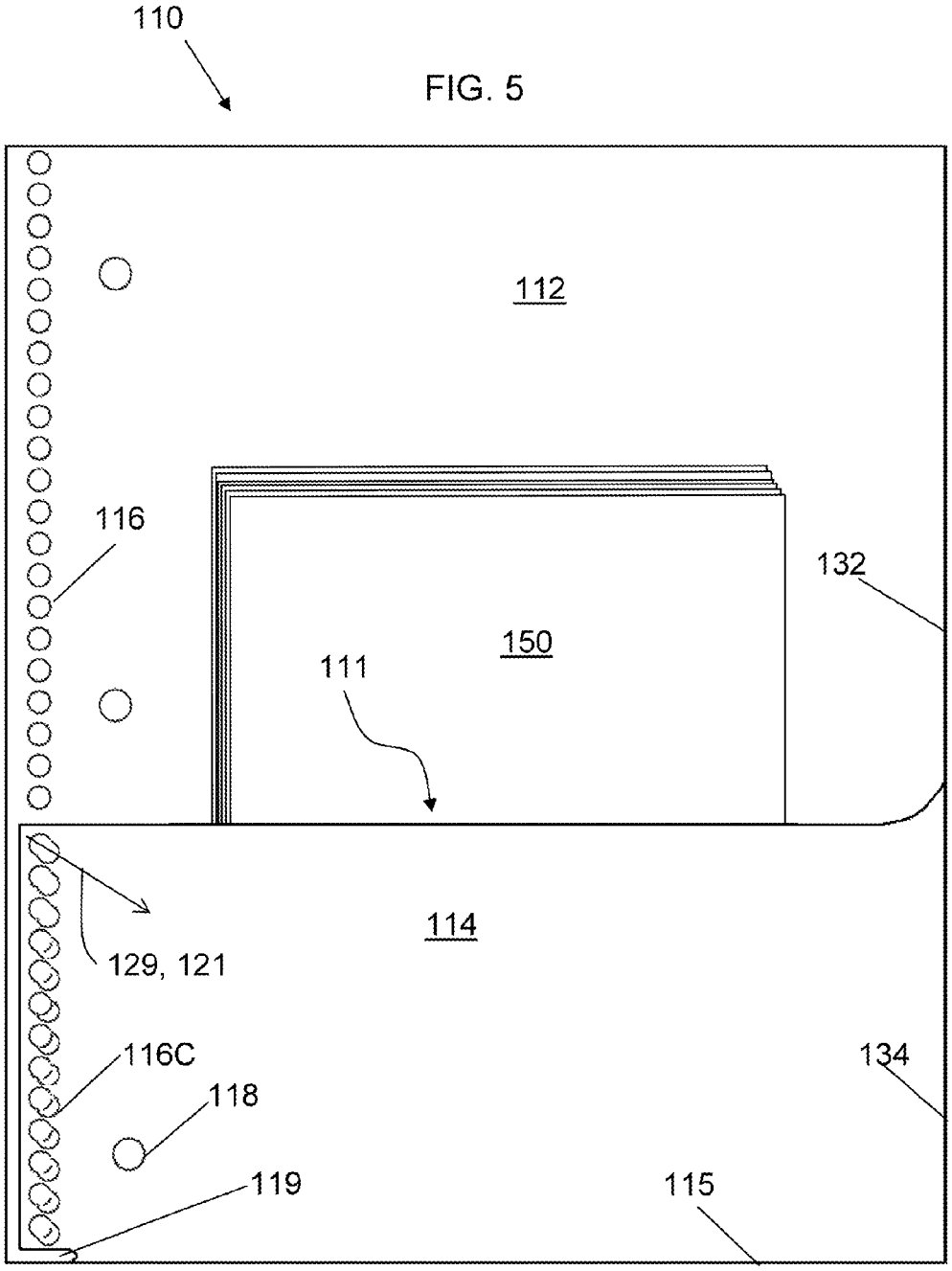
FIG. 5 is a perspective view of the pocket divider of FIG. 4 illustrating certain shifting of the pocket when content items are placed therein.

As shown in FIG. 5, in one case the coil binding holes 116C of the pocket panel 114 are elongated along an axis 129 that is generally aligned with the direction of movement 121. This configuration may help to provide further expansion capabilities to the pocket 111. However, it should be understood that the axis 129 of the coil binding holes 116 may not always be aligned with the direction of movement 121, and the axis 129 may instead form along some other angle other than β1 such that the axis 129 is at angle to the fold lines 115, and/or top and bottom edges of the pocket divider 110 and/or other edges or fold lines thereof, and or at an angle with the central axis of the binding mechanism 14. The axis 129 can form an angle with the top/lateral edges of the panels 112, 114 of between 0 and 90 degrees; more particularly between about 5 and about 40 degrees, and even more particularly between about 15 and about 35 degrees.

Figures 6A, 6B:
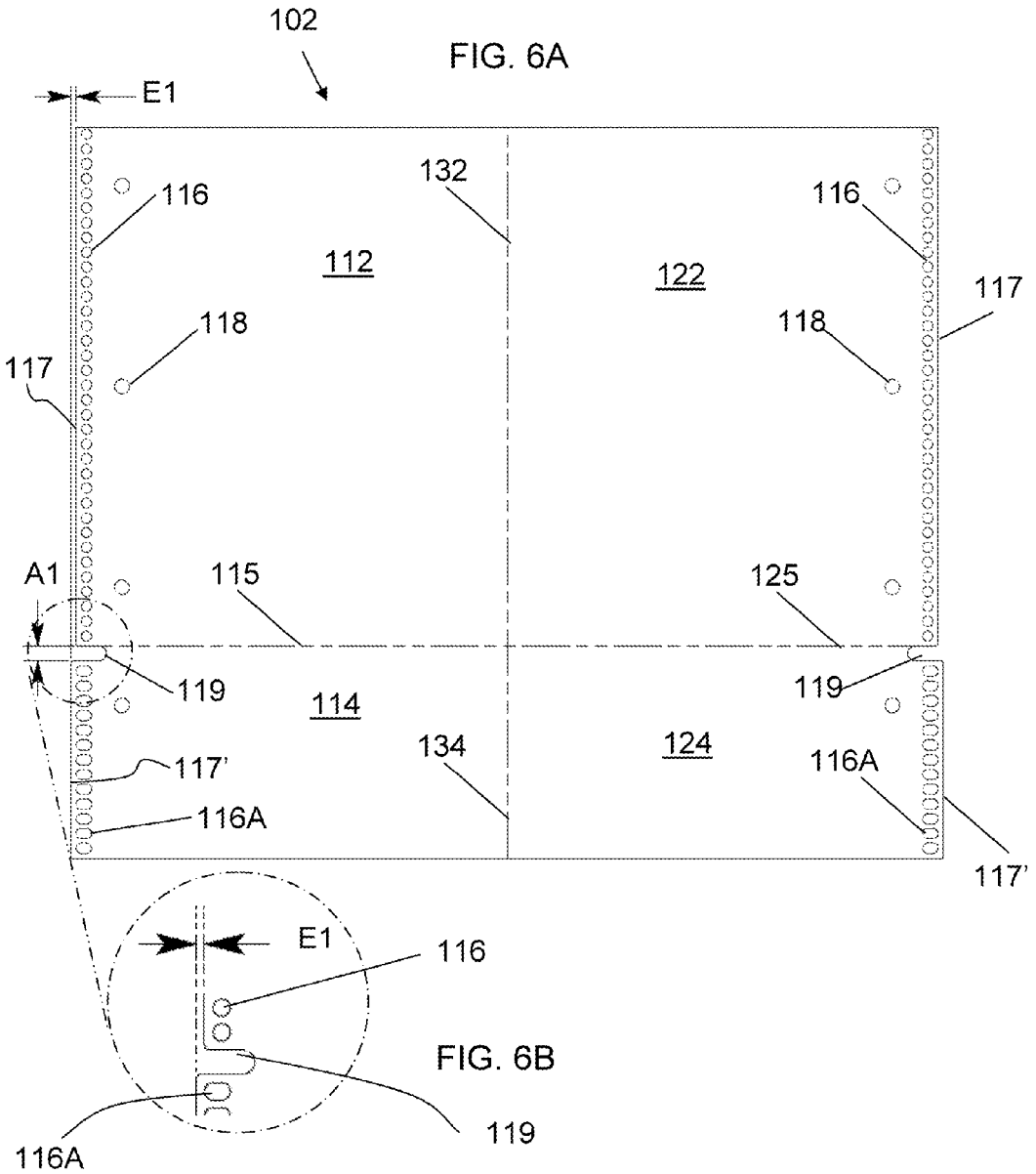
FIG. 6A is a top view of an alternate blank that can be used to form a pocket divider.
FIG. 6B is a detail view of the area indicated in FIG. 6A.

FIG. 6A shows another blank 102 which can be used to form a pocket divider similar to those described above using the same or similar folding/forming techniques as described above. In the blank 102 of FIG. 6A, the pocket panels 114, 124 have an increased lateral width compared to the width of the major panels 112, 122. In particular, the outer edges 117' of the pocket panels 114, 124 protrude outwardly, in the lateral direction, compared to the outer edges 117 of the major panels 112, 122 by a distance E1. In this particular embodiment the inner edges of coil binding holes 116 may be aligned with the inner edges of the elongated coil binding holes 116A. The major panels 112, 122 can have the reduced lateral dimension, compared to the pocket panels 114, 124 since the binding holes 116 are not elongated. The additional lateral width provided to the pocket panels 114, 124, may enable pocket panels 114 to protrude outwardly from the rest of the pocket divider and/or the rest of the notebook 10, including the papers 12, to provide a visual and/or tactile indicator of the pocket divider, while also accommodating the elongated nature of the holes 116A.

FIG. 7A illustrates a blank 103 which can be used to form a pocket divider similar to those described above using the same or similar folding/forming techniques as described above, as shown in FIG. 7B. In this embodiment the blank 103 includes a central cutout 144 at the intersection of the fold lines 115, 125, 132, 134. The cutout 144 helps to reduce a "pinch point" in the corner of the pockets 111 (see FIG. 7B) to enable further expansion and provide further storage capacity to the pockets 111. In the illustrated embodiment, the central cutout 144 is generally circular and positioned on all four panels 112, 114, 122, 124. However, the central cutout 144 can have any of a variety of shapes and configurations, and can be located on various one or combinations of the panels 112, 114, 122, 124.

In FIG. 7A, the ring binding holes 118A on the pocket panels 114, 124 are elongated in generally the same manner as the holes 116A outlined above. The elongated nature of the ring binding holes 118A allows the pockets 111 to expand when the pocket divider is bound to a three ring binder. It should be understood that while the elongated ring binding holes 118A are shown in the embodiment of FIGS. 7A and 7B, the elongated ring binding holes 118A can be used in conjunction with any of the embodiments described herein.

FIG. 8A illustrates a blank 104 which can be used to form a pocket divider as shown in FIG. 8B. In this embodiment, the blank 104 uses reduced-width main panels 112, 122, and the relief cutout 119 includes a vertically extending portion 119A extending generally parallel to the associated edge 117/binding mechanism 14. The vertically extending portion 119A provides further expansion capabilities to the pocket divider by allowing the bottom portions of the pocket panel 114 to move forwardly/downwardly without significantly reducing the number of the bottom-most holes 116A, as shown in FIG. 8B. In addition, in the embodiment of FIGS. 8A and 8B, the central cutout 144 is positioned only on the pocket panels 114, 124. The configurations provides expansion capacity to the pocket panels 114, 124 of the pocket divider, but may provide greater strength and material integrity to the pockets 111 as compared to the full cutout 144 shown in FIGS. 7A and 7B.

FIG. 9A illustrates a blank 105 which can be used to form a pocket divider as shown in FIG. 9B. In this embodiment, the relief cutout 119 includes an angled portion 119C, which provides further expansion capabilities to the pocket divider and similar benefits to the embodiment of FIGS. 8A and 8B. In addition, in the embodiment of FIGS. 9A and 9B, the central cutout 144 is positioned only on the pocket panels 114, 124 and includes a central portion 144A and downwardly extending portions 144B. The central cutout 144 provides expansion capacity to the pocket panels 114, 124 of the pocket divider while providing strength and material integrity to the pockets 111.

Figure 10A:
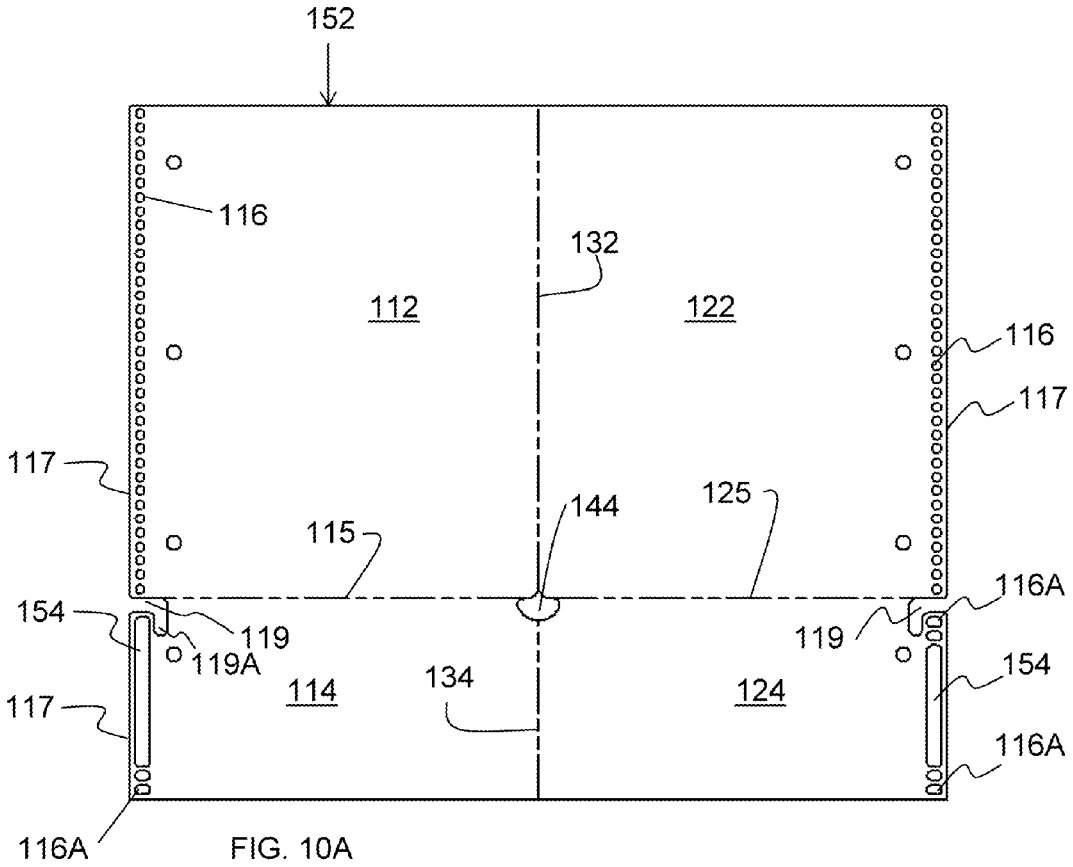
FIG. 10A is a top view of another alternate blank that can be used to form a pocket divider.
Figure 10C:
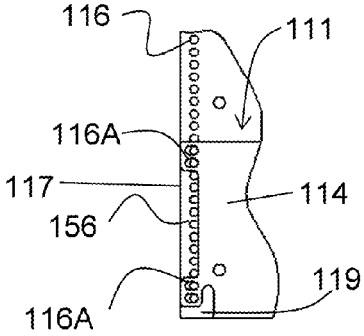
FIG. 10C is a detail view of part of another alternate pocket divider.
Figure 10B:
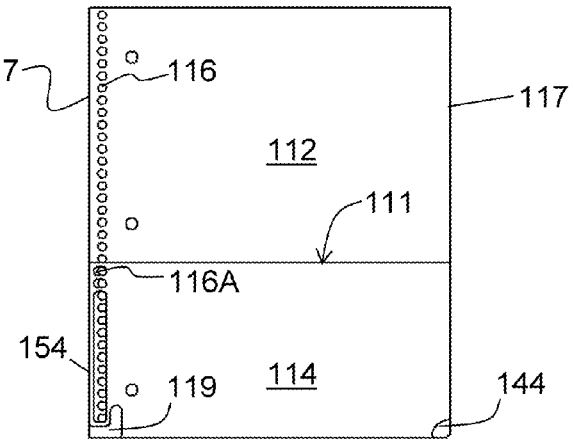
FIG. 10B is a top view of the blank of FIG. 10A formed into a pocket divider.

FIG. 10A illustrates a blank 152 which can be used to form a pocket divider as shown in FIG. 10B. Pocket panel 114 includes a generally vertically extending slot 154, extending generally parallel to the adjacent outer edge 117. The slot 154 can have the same lateral/width dimensions as the holes 116A as described above to enable expansion/movement of the pocket 111, but the slot 154 displaces the individual holes 116A along that portion of the slot 154. The panel 124 of FIG. 10A includes two holes 116A below the slot 154, which are positioned above the slot 154 when the pocket divider is assembled, as shown in FIG. 10B. The holes 116A help to provide some anchoring of the panel 124 relative to the binding mechanism 14. As shown in panel 124 of FIG. 10A, holes 116A can be positioned both above and below the slot 154.

FIG. 10C illustrates another embodiment in which the slot 154 is replaced with a cut-out 156 that extends to the inner edge 117. This embodiment ensures that the cut-out 156 does not block/interfere with lateral movement of the pocket panel 114 during expansion. The slot 154/cut-out 156 can have a height dimension, extending generally parallel to an axis of the binding mechanism 14, that is greater than a height dimension of the holes 116A and/or holes 116. In the embodiment of FIG. 10C the panel 114 includes holes 116A both above and below the cut-out 156, and this configuration can be varied as outlined above.

In this manner it can be seen the system provides a pocket that can be arranged and configured in a variety of manners, and which provides an improved expansion capability while still providing a robust pocket that is easy to manufacture.

Having described the invention in detail and by reference to the various embodiments, it should be understood that modifications and variations thereof are possible without departing from the scope of the claims of the present application.

The invention claimed is:

1. A pocket divider comprising:

a major panel including a plurality of binding holes;

a pocket panel coupled to said major panel and defining a pocket therewith, said pocket panel including at least one binding hole; and a binding mechanism extending through said binding holes of said major panel and said at least one binding hole of said pocket panel, wherein said at least one binding hole of said pocket panel is elongated to provide expansion capacity to said pocket, and wherein said at least one binding hole of said pocket panel directly overlies and is aligned with a selected one of said plurality of binding holes of said major panel, and wherein said selected one of said plurality of binding holes of said major panel includes a lateral width that is less than a lateral width of said at least one hole of said pocket panel to enable said pocket panel to move relative to said major panel to increase a capacity of said pocket.

2. The divider of claim 1 wherein said at least one binding hole of said pocket panel has a width extending along its longest dimension that is longer than a height thereof extending generally perpendicular to said longest dimension.

3. The divider of claim 1 wherein the binding mechanism has a central axis and the at least one binding hole of the pocket panel has a width extending along its greatest dimension which is generally perpendicular to said central axis.

4. The divider of claim 1 wherein said pocket panel includes a plurality of binding holes, each receiving part of said binding mechanism therethrough.

5. The divider of claim 4 wherein each binding hole of said pocket panel is elongated.

6. The divider of claim 1 wherein the binding mechanism includes a plurality of turns, each turn being received through a binding hole of the major panel, wherein the at least one binding hole of the pocket panel has a width extending generally perpendicular to a central axis of the binding mechanism, the width being at least five times greater than a thickness of the associated turn of the binding mechanism.

7. The divider of claim 1 wherein the binding mechanism is a spiral wire binding mechanism or a twin wire binding mechanism.

8. The divider of claim 1 wherein the major panel and pocket panel are made from a single unitary piece of material separated by a pocket fold line, and wherein said pocket panel is generally parallel with and facing said major panel to define said pocket.

9. The divider of claim 1 wherein the pocket panel has a surface area less than a surface area of the major panel.

10. The divider of claim 1 further comprising a supplemental major panel including a plurality of binding holes and a supplemental pocket panel coupled to said supplemental major panel and defining a supplemental pocket therewith, said supplemental pocket panel including at least one binding hole, said supplemental major panel being coupled to said major panel along a major fold line, said supplemental pocket panel being coupled to said pocket panel along a minor fold line, and wherein said binding mechanism extends through said binding holes of said supplemental major panel and said at least one binding hole of said supplemental pocket panel, wherein said at least one of said binding hole of said supplemental pocket panel is elongated to provide increased expansion capacity to said supplemental pocket.

11. The divider of claim 1 wherein the binding mechanism has a central axis and said at least one binding hole of the pocket panel has a width extending along its greatest dimension, and wherein said greatest dimension is positioned at a non-perpendicular angle relative to said central axis.

12. The divider of claim 11 wherein said non-perpendicular angle is between about 5 and about 40 degrees.

13. The divider of claim 1 wherein said pocket includes a cutout at an edge thereof positioned adjacent to said binding mechanism to provide increased expansion capacity to said pocket.

14. The divider of claim 13 wherein said cutout is positioned in said pocket panel and positioned along a lower edge thereof.

15. The divider of claim 14 wherein said cutout includes a portion extending generally parallel to an axis of said binding mechanism.

16. The divider of claim 14 wherein said cutout includes a portion extending at an angle relative to an axis of said binding mechanism.

17. The divider of claim 1 wherein said pocket includes a cutout at an edge thereof positioned laterally opposite to said binding mechanism to provide increase expansion capacity to said pocket.

18. The divider of claim 17 wherein said cutout is positioned in a corner of said pocket.

19. The divider of claim 1 wherein said binding mechanism includes a central axis, and wherein said major panel has a width extending in a direction generally perpendicular to said central axis that is less than a width of said pocket panel.

20. The divider of claim 1 wherein said pocket panel includes a slot or cutout positioned adjacent to said at least one hole of said pocket panel, said slot or cutout having a height dimension, extending generally parallel to an axis of said binding mechanism, that is greater than a height dimension of said at least one hole of said pocket panel.

21. The divider of claim 1 wherein said at least one hole of said pocket panel takes the form of a slot or cutout having a height dimension extending generally parallel to an axis of said binding mechanism.

22. The divider of claim 1 wherein said pocket panel has a lateral width in a direction of said elongation of said at least one binding hole of said pocket panel that is greater than a lateral width of said main panel.

23. A pocket divider comprising:

a major panel including a plurality of binding holes;

a pocket panel coupled to said major panel and defining a pocket therewith, said pocket panel including at least one binding hole directly overlying and aligned with a selected one of said plurality of binding holes of said major panel; and a binding mechanism extending through said binding holes of said major panel and said at least one binding hole of said pocket panel, wherein said at least one binding hole of said pocket panel has a greater lateral width compared to a lateral width of said selected one of said plurality of binding holes of said major panel to enable said pocket panel to move laterally relative to said major panel to increase a capacity of said pocket.

24. The divider of claim 23 wherein said at least one binding hole of said pocket panel is elongated.

25. The divider of claim 23 wherein said at least one binding hole of said pocket panel has a width extending along its longest dimension that is longer than a height thereof extending generally perpendicular to said longest dimension.

26. The divider of claim 23 wherein the binding mechanism is a spiral wire binding mechanism or a twin wire binding mechanism or a ring binding mechanism.

27. The divider of claim 23 wherein said at least one binding hole of said pocket panel takes the form of a slot or cutout having a height dimension extending generally parallel to an axis of said binding mechanism.

28. The divider of claim 23 wherein said pocket panel includes a plurality of binding holes, each hole of said pocket panel being aligned with an associated binding hole of said major panel and receiving a turn of said binding mechanism therethrough.

29. The pocket divider of claim 1 wherein said at least one binding hole of said pocket panel overlies and is aligned with said at least one hole of said major panel with said pocket positioned directly therebetween such that a straight line extending perpendicular to said pocket divider first extends through said binding hole of said pocket panel from a side of said pocket panel, then through said pocket, and then through said at least one hole of said major panel.

30. The pocket divider of claim 1 wherein said selected one of said plurality of binding holes of said major panel is circular.

31. The pocket divider of claim 1 wherein said pocket has four outer edges extending thereabout and three of said outer edges are sealed.

32. The pocket divider of claim 1 wherein said pocket panel is coupled to said major panel along a fold line extending generally perpendicular to said binding mechanism.

33. The pocket divider of claim 10 wherein said plurality of binding holes of said major panel are positioned adjacent an outer edge of said major panel positioned opposite said major fold line.

34. The pocket divider of claim 23 wherein said selected one of said plurality of binding holes of said major panel, aligned with said at least one binding hole of said pocket panel, is not elongated or is less elongated than the associated at least one hole of said pocket panel.

35. A pocket divider comprising:

a major panel including a plurality of binding holes;

a pocket panel coupled to said major panel and defining a pocket therewith, said pocket panel including at least one binding hole; and a binding mechanism extending through said binding holes of said major panel and said at least one binding hole of said pocket panel, wherein said at least one binding hole of said pocket panel has a greater lateral width compared to a lateral width of a selected one of said plurality of binding holes of said major panel, wherein said selected one of said plurality of binding holes of said major panel directly overlies and is aligned with said at least one binding hole of said pocket panel and said pocket panel includes an inner edge positioned adjacent to and extending parallel to said binding mechanism and an outer edge opposite said inner edge, and wherein said pocket panel includes a slot or cutout intersecting said outer edge.

36. A pocket divider comprising:

a first major panel;

a second major panel joined to said first major panel along a major fold line, wherein said first major panel includes a plurality of binding holes positioned adjacent an outer edge located opposite said major fold line, and wherein said second major panel includes a plurality of binding holes positioned adjacent an outer edge located opposite said major fold line;

a first pocket panel coupled to said first major panel and defining a first pocket therewith, said first pocket panel including at least one binding hole;

a second pocket panel coupled to said second major panel and defining a second pocket therewith, said second pocket panel including at least one binding hole; and a binding mechanism extending through said binding holes of said first and second major panels and said at least one binding hole of said first and second pocket panels, wherein a selected one of said binding holes of said first and second major panels directly overlies and is aligned with said at least one binding hole of at least one of said pocket panels, and wherein said at least one binding hole of at least one of said pocket panels is elongated to provide expansion capacity to the associated pocket.

37. The pocket divider of claim 36 wherein said first and second pocket panels and said first and second major panels each include a cutout or slot intersecting said major fold line.

38. The pocket divider of claim 23 wherein said pocket panel includes an inner edge positioned adjacent to and extending parallel to said binding mechanism and an outer edge opposite said inner edge and extending parallel to said binding mechanism, and wherein said pocket panel includes a slot or cutout intersecting said outer edge.

39. The pocket divider of claim 23 further comprising a supplemental major panel including a plurality of binding holes and a supplemental pocket panel coupled to said supplemental major panel and defining a supplemental pocket therewith, said supplemental pocket panel including at least one binding hole, said supplemental major panel being coupled to said major panel along a major fold line, said supplemental pocket panel being coupled to said pocket panel along a minor fold line, and wherein said binding mechanism extends through said binding holes of said supplemental major panel and said at least one binding hole of said supplemental pocket panel, wherein said at least one of said binding hole of said supplemental pocket panel is elongated to provide increased expansion capacity to said supplemental pocket.

40. The pocket divider of claim 35 wherein said at least one binding hole of said pocket panel is elongated to provide expansion capacity to said pocket and said selected one of said plurality of binding holes of said major panel is not elongated or is less elongated than said at least one hole of said pocket panel.

41. The pocket divider of claim 35 wherein said outer edge extends parallel to said binding mechanism.

42. The pocket divider of claim 36 wherein said at least one binding hole of said first pocket panel has a greater lateral width compared to a lateral width of said plurality of binding holes in said first major panel, and wherein said at least one binding hole of said second pocket panel has a greater lateral width compared to a lateral width of said plurality of binding holes in said second major panel.

43. The pocket divider of claim 1 wherein said pocket is positioned directly between said at least one binding hole of said pocket panel and said selected one of said plurality of binding hole of said major panel.

* * * * *